US005719358A

United States Patent [19]

Lindholm

[11] Patent Number: 5,719,358

[45] Date of Patent: Feb. 17, 1998

[54] ARRANGEMENT FOR MUFFLING THE EXHAUST SOUND OF A BOAT MOTOR

[75] Inventor: Jan Erik Lindholm, Älvkarleby, Sweden

[73] Assignee: Ingenjorsfirma Jan Lindholm AB, Alvkarleby, Sweden

[21] Appl. No.: 776,669

[22] PCT Filed: Aug. 10, 1995

[86] PCT No.: PCT/SE95/00919

§ 371 Date: Jan. 31, 1997

§ 102(e) Date: Jan. 31, 1997

[87] PCT Pub. No.: WO96/05099

PCT Pub. Date: Feb. 22, 1996

[30] Foreign Application Priority Data

Aug. 12, 1994 [SE] Sweden ..... 9402709

[51] Int. Cl.[6] ..... B63H 21/32; F01N 7/12

[52] U.S. Cl. ..... 181/235; 440/89

[58] Field of Search ..... 181/235, 255, 181/259, 260, 263; 440/89

[56] References Cited

U.S. PATENT DOCUMENTS

| | | | |
|---|---|---|---|
| 3,282,373 | 11/1966 | Gazzara | 181/235 |
| 4,002,136 | 1/1977 | Michalak . | |
| 4,744,778 | 5/1988 | Porter . | |
| 4,786,265 | 11/1988 | Porter . | |
| 4,840,589 | 6/1989 | Breaux . | |
| 4,977,977 | 12/1990 | Von Widmann et al. . | |
| 5,007,870 | 4/1991 | Okubo et al. . | |
| 5,045,005 | 9/1991 | Miles, Jr. . | |
| 5,094,640 | 3/1992 | Burdick et al. . | |
| 5,441,432 | 8/1995 | Rodskier et al. . | |
| 5,550,337 | 8/1996 | Tazaki et al. | 181/235 |

FOREIGN PATENT DOCUMENTS

| | | |
|---|---|---|
| 158 780 | 7/1990 | Denmark . |
| 0 088 640 | 9/1983 | European Pat. Off. . |
| 422 846 | 12/1925 | Germany . |
| 33 21 782 | 12/1984 | Germany . |
| 37 43 798 | 7/1989 | Germany . |
| 156 821 | 8/1987 | Norway . |
| 468 386 | 1/1993 | Sweden . |
| WO 93/07053 | 4/1993 | WIPO . |

*Primary Examiner*—Khanh Dang
*Attorney, Agent, or Firm*—Young & Thompson

[57] ABSTRACT

A muffler for muffling the exhaust sound of a motor boat having a diesel motor. The exhaust gases of the motor are led to a buffer chamber that is located beneath the waterline of the boat and mounted on a trim tab fitted to the transom of the boat. The bottom of the chamber is formed by the trim tab and includes a slot, which extends transversely to the direction of water flow. A flow casing through which exhaust gases exit into the water is provided beneath the slot.

8 Claims, 1 Drawing Sheet

ARRANGEMENT FOR MUFFLING THE EXHAUST SOUND OF A BOAT MOTOR

BACKGROUND OF THE INVENTION

The present invention relates to an arrangement for muffling the exhaust sound of boat motors. The invention is concerned primarily with boats that are fitted with two-stroke diesel motors or engines. Pronounced and abrupt variations in pressure are generated in the exhaust conduits of such motors, resulting in highly disturbing noise, particularly in the case of large motors or engines. By large is meant here a motor or engine power of from about 300 hp to 2,000 hp or more.

It is known to dampen exhaust sound with conventional mufflers constructed, for instance, of chambers which have perforated internal partition walls or are filled with flow-attenuating material. In the case of large two-stroke diesel motors, however, these mufflers are extremely bulky and take up a large amount of space in the stern of the boat. They are also expensive, among other things because the exhaust gases are mixed with cooling water and hence require the application of special technical solutions and materials.

In the case of outboard motors for instance, exhaust sound can be dampened by leading the exhaust gases out into the water. However, with regard to a large diesel motor, and especially a two-stroke diesel motor, quite different conditions apply. It is essential in motors of this kind that the counterpressure in the exhaust conduit is low and does not exceed a given highest value, so as not to impair the running properties of the motor. The increased counter-pressure that occurs when the exhaust conduit is extended down so as to discharge beneath the surface of the water creates a serious drawback. Another problem is that under certain conditions subpressures are liable to occur in the exhaust conduit, for instance when the motor is stopped abruptly. If the exhaust conduit discharges beneath the surface of the water, water may be drawn into the conduit by suction and, in the worst case, reach the motor and cause damage thereto.

Because of these problems, present-day conventional large two-stroke diesel motor installations, and also other motor installations, include an exhaust pipe which discharges into the ambient air, often in the transom of the vessel, without including a muffler. Such installations result in highly disturbing noise.

An attempt to reduce noise is reported in U.S. Pat. No. 4,002,136. This publication describes a boat in whose stern there has been built on each side of the boat a box or chamber 20 which lies partially beneath the waterline of the boat. An exhaust pipe 16 extending from the boat motor 12 discharges into the chamber 20 above the waterline. The bottom of the chamber is formed by the bottom of the hull of the boat and has an open slot 52 through which exhaust gases can flow out into the water. The transom 31 of the boat contains a plurality of through-penetrating openings 40 which connect that part of the chamber located above the water with the surroundings. When the motor is idling or running at low speeds, the openings 40 prevent a counter-pressure build-up in the chamber of such magnitude as to impair running of the motor. The open slot or gap 52 is adapted so that as the boat makes speed in a forward direction, the water flow will facilitate the outflow of exhaust gases.

DE 422,846 describes a motor boat whose bottom includes a downwardly open exhaust chamber b into which an exhaust pipe d discharges. There is pivotally mounted in the chamber b a flap c which is caused by the water flowing past the flap to take a position in which exhaust gases can be drawn from the chamber by suction both when the boat moves forwards and when the boat moves backwards.

U.S. Pat. No. 5,007,870 teaches a water scooter which includes a water-jet drive. In the embodiments illustrated in FIGS. 7 and 8, an exhaust pipe 22 extends out through the transom of the vessel and discharges into a muffler box 38 mounted externally of the transom. The bottom of the box 38 includes an opening 39 through which exhaust gases can flow out into the water.

SUMMARY OF THE INVENTION

The object of the present invention is to greatly reduce the motor exhaust sound of a large diesel motor of a boat in a simple and inexpensive manner without impairing the running properties of the motor and without encroaching on the space inboard of the boat.

This object is achieved in accordance with the invention with an arrangement comprising a buffer chamber (expansion chamber) immediately upstream of the exhaust outlet opening or openings that enables the exhaust gases to be discharged into the water without influencing the running properties of the motor. The buffer chamber lies at least partially, preferably completely, beneath the waterline when the boat is stationary.

By mounting the buffer chamber on a trim tab, an existing boat can be fitted easily with an exhaust silencing facility without needing to interfere mechanically with the motor installation and the exhaust system. In this regard, the trim tab can be fitted to the transom of the existing boat and the buffer chamber connected to the exhaust pipe terminating in the boat transom with the aid of a connecting conduit which is appropriately flexible to enable an adjustable trim tab to be easily fitted.

According to one preferred embodiment of the invention, the at least one exhaust outlet opening includes a plurality of opening parts that are located at mutually different depths below the waterline. The opening may have the form of an elongated slot or a plurality of mutually separate holes. By arranging different parts of the opening at different depths there is afforded the advantage that when the motor runs at a low speed and is particularly sensitive to counterpressure in the exhaust system only that part of the exhaust outlet opening which lies immediately below the surface of the water is used. Both pressure and volume of the exhaust gases increase at higher motor speeds, wherewith progressively deeper parts of the exhaust outlet opening will be used for the release of exhaust gases. The water pressure will act as a damping spring on the volume of exhaust gas in the buffer chamber and therewith dampen pressure variations that give rise to exhaust sound.

With this construction no direct connection is required between the buffer chamber and the surroundings in order to maintain the counterpressure in the exhaust gas system at an acceptable level at low motor speeds. The exhaust outlet opening which opens into the water constitutes the only connection between the motor exhaust system and the surroundings, thereby muffling the exhaust sound very effectively.

In order to utilize the flow of water in the vicinity of the exhaust outlet opening to lower the counterpressure in the exhaust system, further characteristics of the inventive arrangement are set forth herein.

BRIEF DESCRIPTION OF THE DRAWINGS

An exemplifying embodiment of the invention will now be described in more detail with reference to the accompanying drawings, in which FIG. 2 is a sectional view taken on the line II—II in FIG. 1 and also shows an alternative embodiment of an inventive sound-damping arrangement.

DESCRIPTION OF THE PREFERRED EMBODIMENTS

Figure 1:
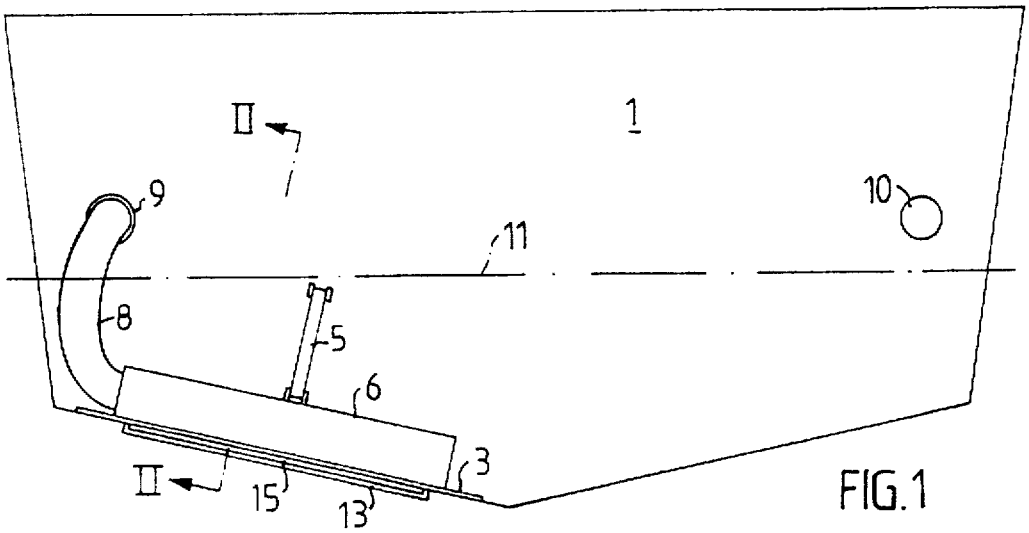

The Figures illustrate the stern part of a large motor boat which includes a transom 1 and a boat bottom 2. As shown on the left in FIGS. 1 and 2, the boat includes a trim tab 3 which is connected to the transom 1 so that the bottom surface of the trim tab 3 will form a continuation of the outside of the bottom 2. The trim tab 3 can be pivoted about a pivot 4, shown schematically in FIG. 2, with the aid of a hydraulic piston-cylinder device 5 or the like, also shown schematically. The trim tab 3 carries an elongated, generally rectangular box 6. The bottom of the box 6 is formed by the trim tab 3 itself and the short sides of the box are closed by means of walls. One end of a flexible pipe 8 opens in the left wall 7 shown in FIG. 2, while the other end of the flexible pipe is connected by means of a muff 9 to an exhaust pipe 10 that extends through the transom 1 of the boat. As will be seen from FIG. 1, the boat has two exhaust pipes 10, each of which is connected to a respective two-stroke diesel motor (not shown) in the absence of an intermediate muffler or silencer. The trim tab 3 and the box 6 are fully submerged beneath the water when the boat is stationary. The surface of the water or the boat waterline is indicated by the chain line 11.

The box 6 is empty and forms a buffer chamber or expansion chamber for the exhaust gases generated by the motor. The exhaust gases exit from the chamber through one or more openings 12 provided in the trim tab 3. In the illustrated embodiment, the trim tab 3 includes a long opening in the form of a slot 12 which extends parallel with the leading edge of the trim tab 3. Arranged beneath the slot 12 is a casing or cover 13 whose front edge 14 is connected to the underside of the trim tab 3 in the manner of a hood and extends therefrom rearwardly so that its rear edge 15 lies behind the rear edge of the slot 12. As the boat moves forwards in the water, the flow of water at the rear edge 15 of the casing 13 will generate a drop in pressure and therewith facilitate the outflow of exhaust gases and thereby lower the counterpressure in the motor exhaust system.

The slot 12 or corresponding other exhaust outlet openings shall lie as far forwards of the trailing edge of the trim tab 3 as to provide the exhaust gases with a sufficiently long path in which to mix with the water rearwardly of the slot, even when the boat speeds through the water. When this distance is too short, a continuous exhaust gas channel is able to form on the underside of the trim tab from the slot 12 all the way to the trailing edge of the trim tab 3 and the free ambient air, therewith greatly impairing the sound-attenuating effect.

The buffer chamber 6 will be full of water when the motor is not running. When the motor is started-up, the exhaust gases expel water through the slot 12 until the level of the water in the chamber has fallen to the level of the slot 12, whereafter exhaust gases begin to exit through the slot. Because the trim tab 3 is inclined laterally in relation to the horizontal plane, exhaust gases will first exit through the highest part of the slot 12, which in the left part of FIG. 1 is the left end proximal to the inlet of the exhaust conduit 8.

When the motor idles, only a small part of the length of the slot 12 will be used for exhaust gas emission. As the speed of the motor increases, the volume of exhaust gas will also increase, and therewith the pressure in the buffer chamber 6, so that the exhaust gases will be emitted over a progressively larger part of the length of the slot 12. As the boat moves forwards in the water, the flow of water past the casing 13 will also function to lower the pressure in the outlet slot 12 and therewith in the chamber 6, so that a larger part of the slot will be utilized for the emission of exhaust gases. The boat will plane when propelled at high speeds, wherewith no water will remain in the chamber 6 and the chamber will be completely filled with exhaust gases instead.

The buffer chamber 6 has a double function. It forms a pressure equalizing space similar to a gas spring, which equalizes the large and abrupt pressure changes in the motor exhaust system. This prevents the propagation of powerful pressure waves back through the exhaust system such as to reach the motor and impair its performance, which would be the result if the exhaust pipe was simply extended down into the water, for instance. The volume of gas in the buffer chamber 6 increases initially with increasing motor speeds, because more water is pressed out through the slot 12. This means that the pressure equalizing ability of the buffer chamber will increase with increasing pressure changes in the exhaust gases, which is favourable. The volume of gas in the chamber 6 is at a maximum when the boat is propelled in planing mode.

The second function of the buffer chamber 6 is to form a water-collecting chamber. In the event of a subpressure occurring in the motor exhaust system, which may happen, for instance, when the motor is stopped abruptly, water will be drawn in through the slot 12 or corresponding other exhaust outlet openings. The water, however, will first fill the chamber 6 before being able to flow further into the exhaust system. This prevents the water reaching the motor and damaging the same.

Figure 2:
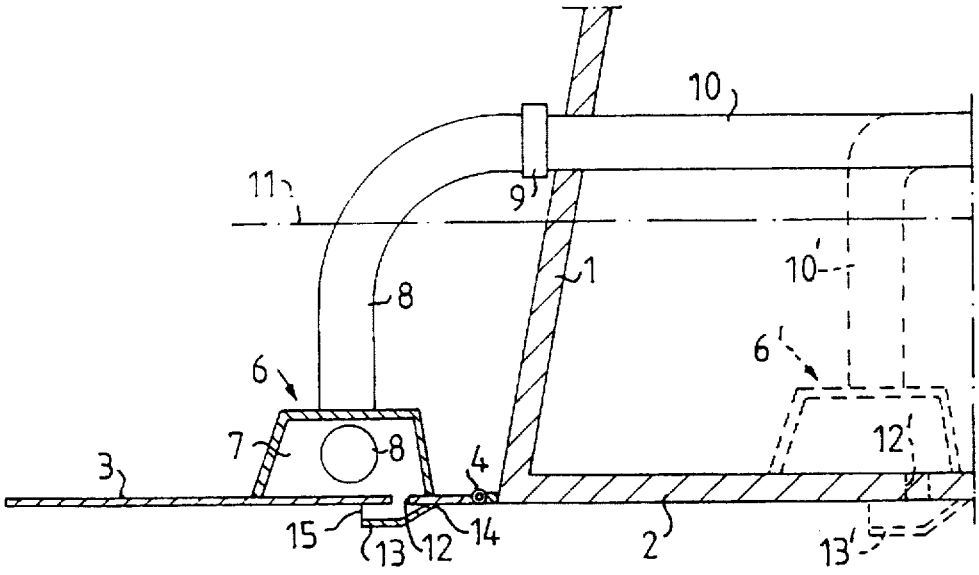
FIG. 2 is a rear view of a boat, wherein the left and the right sides of the Figure illustrate respectively the boat when equipped with an inventive silencing arrangement and when not equipped with such an arrangement.

FIG. 2 illustrates in broken lines an embodiment of the invention which is an alternative to the trim tab 3 fitted to the transom. In this embodiment, a buffer chamber 6' in the form of a rectangular box is mounted inboard at a short distance in front of the transom 1. The bottom of the box is formed by the bottom 2 of the boat. The boat bottom 2 includes a slot-like opening 12' corresponding to the outlet slot 12 in the trim tab 3, and a casing 13' corresponding to the casing 13 is mounted beneath the slot. The motor exhaust pipe 10' is connected to the upper side of the buffer chamber 6'.

What is claimed is:

1. A muffler for muffling the exhaust sound of a motor boat having a diesel motor to which there is connected an exhaust conduit (10) through which exhaust gases are expelled, wherein said muffler includes at least one buffer chamber (6) which is located beneath the waterline (11) when the boat is stationary in the water and which is connected to the exhaust conduit (10), and at least one exhaust outlet opening (12) which communicates with the interior of the buffer chamber (6) and which discharges into the water when the boat moves through the water, wherein the buffer chamber (6) is located on a boat trim tab (3) which is pivotal (4,5) in relation to a hull (1,2) of the boat; wherein said at least one exhaust outlet opening (12) is provided in a bottom surface of the trim tab (3); and wherein said buffer chamber (6) is connected to the exhaust conduit (10) of the boat by means of a connecting conduit (8).

2. The muffler according to claim 1, wherein the connecting conduit includes a flexible pipeline (8) between the exhaust conduit (10) and the buffer chamber (6).

3. The muffler according to claim 1, wherein said at least one exhaust outlet opening (12) includes a plurality of opening parts that are located at mutually different depths beneath the waterline (11).

4. The muffler according to claim 1, wherein said at least one exhaust outlet opening has the form of a slot (12) which extends generally transversely to the direction in which water flows when the boat moves through the water.

5. The muffler according to claim 1, wherein the trim tab (3) forms a bottom of the buffer chamber (6).

6. The muffler according to claim 1, wherein said at least one exhaust outlet opening (12) constitutes the only outlet for the exhaust conduit (10).

7. The muffler according to claim 1, wherein the buffer chamber (6) is located fully beneath the waterline of the boat and is full of water when the motor is not running.

8. The muffler according to claim 7, further comprising a casing means (13) which covers a bottom of the exhaust outlet opening (12), wherein the casing means has a front edge (14) which is connected to an underside of the trim tab (3) upstream of the exhaust outlet opening, and a rear edge (15) which forms a rearwardly facing opening downstream of the exhaust outlet opening (12), whereby the water flowing past said casing means generates a drop in pressure in said exhaust outlet opening such as to suck out exhaust gases.

* * * * *